United States Patent [19]

Chang

[11] Patent Number: 4,519,881

[45] Date of Patent: May 28, 1985

[54] REGENERATION OF ALKALINE TREATING AGENTS

[75] Inventor: Yuehsiung Chang, Naperville, Ill.

[73] Assignee: Standard Oil Company (Indiana), Chicago, Ill.

[21] Appl. No.: 623,944

[22] Filed: Jun. 25, 1984

[51] Int. Cl.[3] ..... C02C 5/12; C25B 1/20

[52] U.S. Cl. ..... 204/149; 204/98; 204/128; 204/104; 204/180 P; 423/234; 423/245

[58] Field of Search ..... 204/98, 99, 104, 128, 204/180 P, 149; 423/234, 245

[56] References Cited

U.S. PATENT DOCUMENTS

| | | | |
|---|---|---|---|
| 3,801,698 | 4/1974 | Lowrance et al. | 204/98 |
| 3,806,435 | 4/1974 | Ohta et al. | 204/152 |
| 4,041,129 | 8/1977 | Foster et al. | 204/104 |
| 4,191,620 | 3/1980 | Young et al. | 204/149 |
| 4,246,079 | 1/1981 | Goodrich et al. | 204/98 |

*Primary Examiner*—Howard S. Williams
*Assistant Examiner*—Terryence Chapman
*Attorney, Agent, or Firm*—William C. Clarke; William T. McClain; William H. Magidson

[57] ABSTRACT

A process is disclosed for electrolysis of a spent caustic solution in a three-compartment cell to produce alkali metal hydroxide, hydrogen and hydrogen sulfide. The hydrogen sulfide is oxidized to sulfur dioxide which is returned to the electrolysis cell to form sulfuric acid.

5 Claims, 1 Drawing Figure

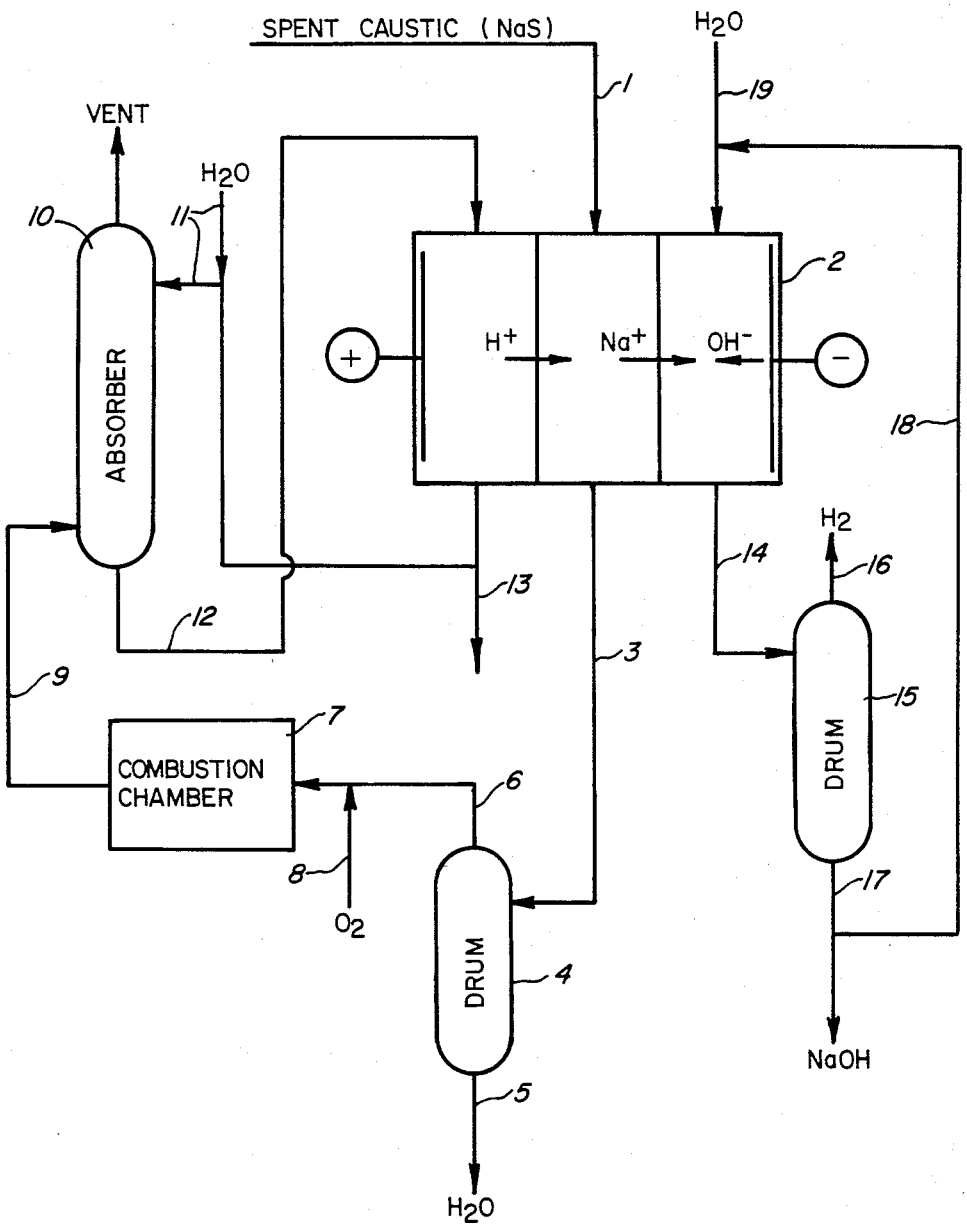
SPENT CAUSTIC (NaS)
H2O
1
19
VENT
H2O
10
11
2
ABSORBER
H+
Na+
OH-
18
H2
14
16
13
12
3
9
15
7
COMBUSTION CHAMBER
DRUM
6
8
17
O2
DRUM
4
NaOH
5
H2O

REGENERATION OF ALKALINE TREATING AGENTS

FIELD OF THE INVENTION

The field of this invention relates to the regeneration of alkaline treating agents containing alkali metal sulfides by electrolysis treatment to produce sodium hydroxide, sulfuric acid and hydrogen.

Electrolysis is a well-known electrochemical process for separating cations and/or anions and depends for such separation on the use of conductive (electrolyte) solutions, the imposition of an electrical potential between a positively charged electrode (anode) and a negatively charged electrode (cathode), each positioned within an electrolyte (the same or different) solution in an electrolysis cell. The positioning of one or more electrolysis (selective or non-selective) membranes between the anode and cathode provides the desired separation.

It is known in the art to electrolytically regenerate alkaline treating agents which have been used in the treatment of mineral oil fractions. Such regeneration may be accomplished by passing the used caustic soda through an electrolytic cell to which electric current is supplied at a suitable voltage. The water in the caustic soda is electrolyzed, oxygen and hydrogen being thereby formed. The oxygen reacts with the sodium mercaptides to form disulfides, or with sodium sulfide to form free sulfur or other products. The disulfides can be subsequently separated from the caustic soda, for example by extraction with naphtha.

Electrolytic regeneration provides an advantageous reduction in mercaptide and sulfide content of caustic, but has been found to produce unsatisfactory results when sulfides are present in the caustic which is to be regenerated, in that the sulfides form not only free sulfur but undesirable products such as sulfites, sulfates, etc. which may ultimately precipitate from the caustic and cause, in addition to neutralization of the caustic and other undesirable effects, severe deposition difficulties in the electrolytic cell and elsewhere in the caustic circulation system.

The present invention provides a process in which hydrogen sulfide ($H_2S$) produced by the electrolysis of sodium sulfide ($Na_2S$) in the presence of hydrogen ions ($H^+$) is combusted to form sulfur dioxide ($SO_2$) which, in turn, is oxidized electrolytically in the presence of water ($H_2O$ ) to form sulfuric acid ($H_2SO_4$) and to provide a source of hydrogen ions ($H^+$) for the electrolysis of sodium sulfide. The electrolysis of sodium sulfide also produces sodium ions ($Na^+$) which react in the presence of water to form sodium hydroxide (NaOH) and hydrogen ($H_2$). The invented process is accomplished by means of a three-compartment electrolysis cell and an external combustion chamber to oxidize the $H_2S$ to sulfur dioxide.

Accordingly, this invention provides an electrochemical process to regenerate sodium hydroxide from caustic solutions containing sulfides for further treatment of mineral oil fractions containing sulfur compounds while producing hydrogen and sulfuric acid. The spent solutions, after removal of sulfide content can be recycled as make-up water to the caustic wash tower. This invention provides a process for recovering a spent caustic solution from an environmentally undesirable stream wherein sulfur contaminants are present in an amount too low to economically distill or extract and which, upon recovery, present the further problem of disposal.

It is an objective of this invention to recover sodium hydroxide, sulfuric acid and hydrogen from a spent caustic solution containing sulfide contaminants.

It is a further objective of this invention to present a solution to an environmental problem which results in recovery of products with economic value, i.e., sodium hydroxide, sulfuric acid and hydrogen.

BACKGROUND OF THE INVENTION

Alkaline solutions are especially suitable for the purification of hydrocarbon fractions and particularly sour gasolines including cracked gasoline, straight run gasoline or mixtures thereof, naphtha, jet fuel, kerosene, aromatic solvent, stove oil, range oil, burner oil, fuel oil, etc. Other hydrocarbon fractions include lubricating oil, gas oil, etc., as well as normally gaseous fractions. In addition, other organic fractions containing acidic impurities which may be treated in this manner include, for example, alcohols, ketones, aldehydes, etc.

After the hydrocarbon or other organic fraction has been contacted with the alkaline reagent and the acidic components reacted with and/or absorbed in the alkaline reagent, the purified fraction is separated from the alkaline solution. The alkaline solution then is sent for regeneration in order to remove the acidic components and to restore the activity of the alkaline reagent for further use in the process.

In the prior art a number of patents teach regeneration of aqueous alkaline waste waters by electrochemical means. U.S. Pat. No. 3,801,698 teaches a process for regenerating an aqueous alkali metal sulfate solution in an electrolytic process whereby aqueous sulfuric acid or an aqueous mixture of sulfuric acid and alkali metal sulfate is collected at the anode and is recycled, and aqueous alkali metal hydroxide which forms at the cathode is recycled. Separation of the hydrocarbon phase occurs by settling from the alkali metal hydroxide aqueous solution. U.S. Pat. No. 3,806,435 teaches a process for treating waste liquor containing one or more sulfidic contaminants by an electrolytic treatment using an anode of iron/aluminum or zinc/aluminum and a cathode of iron or zinc, thereby eliminating the sulfidic contamination by forming iron or zinc sulfide which is thereupon precipitated with $Al(OH)_2$ formed by decomposition of the composite anode. U.S. Pat. No. 4,041,129 teaches a process for reducing carbon dioxide and/or hydrogen sulfide levels in a hydrocarbon gas. The process consists of passing the gas through an aqueous sodium hydroxide solution, reacting the effluent liquid with sulfuric acid, stripping the acidic gases therefrom and subjecting the resulting aqueous sodium sulfate solution to electrolysis to regenerate sodium hydroxide and sulfuric acid. The cell used can be a three-compartment cell having an ion-exchange membrane selectively permeable to cations defining the cation compartment and a spaced acid-resistant hydraulically permeable diaphragm defining the anode chamber. The salt solution is passed into the center compartment. Deionized water is passed into the cathode compartment. Migration of the cations into the cathode compartment yields the corresponding metal hydroxide with hydroxyl ions produced by electrolysis of water. Anions in the anode compartment combine with hydrogen ions produced by electrolysis of water to produce the corresponding acid. U.S. Pat. No. 4,246,079 teaches a process wherein sulfur compounds are removed from a hydrocarbon stream by contacting the stream with caustic to partially remove the sulfur compounds, then carbonating the spent caustic solution and passing the carbonate salt solution into an electrolytic cell to convert the alkali metal salt to the alkali metal hydroxide.

However, processes taught in the prior art have several inherent disadvantages. Among the products of the process of U.S. Pat. No. 3,801,698 are sodium sulfate, carbon dioxide and sulfur. The process requires extensive process equipment and the products are not all immediately usable. The process of U.S. Pat. No. 3,806,435 produces iron or zinc sulfide which is precipitated with aluminum hydroxide obtained by decomposition of the anode. Constant replacement of the anode is accordingly required. The process of U.S. Pat. No. 4,246,079 requires that the concentration of sulfuric acid be closely monitored and a substantial portion of the process equipment may have to be constructed of stainless steel to reduce corrosion. The products of the process of U.S. Pat. No. 4,246,079 are not immediately reusable, such as sulfur, without further processing.

The instant invention is directed to a process wherein the products are directly reusable in a refinery operation and which has only a minimal effect on plant wastewater facilities. The process results in relatively high purity alkali metal hydroxide, sulfuric acid and hydrogen.

SUMMARY OF THE INVENTION

A process for the regeneration of a spent caustic solution containing sulfur contaminants whereby electrolysis in a three-compartment cell produces alkali metal hydroxide, sulfuric acid and hydrogen sulfide. The hydrogen sulfide is combusted in the presence of oxygen to yield sulfur dioxide which is returned to the anodic compartment of the electrolysis cell to be oxidized to form sulfuric acid.

DESCRIPTION OF THE DRAWING

The FIGURE is a block diagram of the process for caustic regeneration and hydrogen/sulfuric acid production from spent caustic.

DETAILED DESCRIPTION OF THE INVENTION

The electrochemical process uses as feed the aqueous alkaline waste liquor containing alkali metal sulfides. The reactions in the three-compartments are:

(a) In the central compartment $$Na_2S \rightarrow 2Na^+ + S^=$$

$$2H^+ + S^= \rightarrow H_2S$$

(b) In the anolyte compartment $$SO_2 + 2H_2O \rightarrow H_2SO_4 + 2H^+ + 2e^-$$

(c) In the catholyte compartment $$2H_2O + 2e^- \rightarrow 2OH^- + H_2$$

$$2Na^+ + 2OH^- \rightarrow 2NaOH$$

The hydrogen ion in the anolyte compartment migrates across the cation permeable membrane into the central compartment to form hydrogen sulfide. The hydrogen sulfide is removed from the central compartment and is oxidized in an external furnace in the presence of oxygen to form sulfur dioxide, $SO_2$. The sulfur dioxide is returned to the anolyte compartment to be oxidized electrolytically in the presence of water to form sulfuric acid. The sodium ion from the central compartment migrates across the cation permeable membrane into the catholyte compartment to form sodium hydroxide (NaOH) by combining with hydroxyl ions ($OH^-$) produced by electrolysis of water.

Aqueous sulfuric acid containing sulfur dioxide is used as anolyte. Aqueous sodium hydroxide is used as catholyte. Aqueous sulfuric acid of increased $H_2SO_4$ content is removed from the anolyte compartment. An aqueous solution of hydrogen sulfide is removed from the feed receiving compartment and separated into water and gaseous hydrogen sulfide which is burned to sulfur dioxide. The sulfur dioxide is absorbed in dilute aqueous sulfurous acid and sulfuric acid to provide anolyte solution for electrolysis. Aqueous sodium hydroxide solution of increased NaOH content and containing hydrogen gas is removed from the catholyte compartment. Part of the heat produced by combustion of hydrogen sulfide to sulfur dioxide and water can be used by indirect heat exchange both to complete the disengagement of hydrogen sulfide from the aqueous effluent from the central or feed compartment and to complete the disengagement of hydrogen from the aqueous caustic effluent from the catholyte compartment. It is calculated that for each kilogram of $Na_2S$ in the aqueous waste 1.025 kg NaOH, 1.25 kg $H_2SO_4$ and 283 normal (at 25° C. and one atmosphere) liters of hydrogen are produced.

The electrolysis cell comprises an alternating array of cation permeable membranes which together with end caps and seal support delimit compartments or channels. The end caps and seal supports are non-conductive and liquid impermeable and are joined to form the outer boundary of the cell. The end compartments or channels are defined by an end cap and a membrane. Disposed within one end channel is a suitable anode and disposed within the opposite end channel is a suitable cathode. The anode and cathode are connected respectively to the positive and negative terminals of a suitable direct current power source. The anode-containing channel has therein the anolyte and the cathode-containing channel contains the catholyte.

An industrial electrolysis cell can be of any well-known type of membrane assembly such as a plate and frame type assembly containing a plurality of planar membranes in parallel spaced relation with about one millimeter space between each membrane. The electrolysis cell can have a number of repeating separation units which can vary in configuration from two to five channels per separation unit depending upon the character and nature of the ions being transported for separation, the transporting solvents and electrolytes. The order of cation permeation membranes in each repeating unit will vary with the separation or separations to be effected.

Referring to the FIGURE, an invented electrolysis process is shown for removing sulfur compounds from a spent caustic fluid together with means for treating the resulting sulfur dioxide compounds to prepare sulfuric acid. In this FIGURE, valves, controls, service lines and other items not essential to the understanding of this invention have been deleted for simplicity. While the following embodiment is directed toward hydrocarbon-containing feedstocks arising out of petroleum refining processes, the process is also applicable to feedstocks containing sulfur compounds but arising out of other processes such as wood pulping and certain food processing operations.

Spent caustic feedstock is fed into a three-compartment electrolysis cell by line 1. The three-compartment electrolysis cell 2 employs three compartments separated by two membranes selectively permeable to cations. The spent caustic solution is passed to the center compartment. The spent solution, containing hydrogen sulfide, is removed from the center compartment by line 3 at a pH of 6 to 7 and transferred to drum 4 where it is removed from the aqueous component. The water is removed from drum 4 by line 5. Hydrogen sulfide from drum 4 is passed by line 6 to combustion chamber 7. Oxygen is added to line 6 by line 8. Resulting sulfur dioxide is passed by line 9 to absorber 10. Water and sulfuric acid are added to absorber 10 by line 11. Sulfurous acid is removed from absorber 11 by line 12 and passed to the cathode compartment of the three-compartment cell 2. Sulfuric acid is removed from the cathode compartment by line 13. Sodium hydroxide and hydrogen are removed from the anode compartment by line 14 to drum 15. Hydrogen is removed from drum 15 by line 16 and sodium hydroxide is removed by line 17. A portion of the sodium hydroxide is recycled by line 18 to the anode compartment of electrolysis cell 2. Water is added to the anode compartment by line 19.

In summary, the invention comprises a process for regenerating aqueous caustic from a feed of aqueous sulfidic waste liquor containing alkali metal sulfides which comprises a combination of electrolysis and oxidation wherein said aqueous waste liquor is fed to an electrolysis cell comprising three compartments; (a) an anolyte compartment formed by the anode and a first cation permeable membrane, (b) a feed receiving compartment formed by the first cation permeable membrane and a second cation permeable membrane, and (c) a catholyte compartment formed by said second cation permeable membrane and the cathode in which the anolyte is an aqueous solution of sulfuric acid and sulfur dioxide and the catholyte is an aqueous solution of sodium hydroxide, the effluent from said anolyte compartment is aqueous sulfuric acid, effluent from said feed compartment is hydrogen sulfide and a spent aqueous solution of alkali metal sulfides, effluent from said catholyte compartment is hydrogen and regenerated sodium hydroxide wherein said hydrogen sulfide is burned in a combustion zone to sulfur dioxide which is absorbed in aqueous sulfuric acid.

In the process of the instant invention, the said feed of aqueous sulfidic waste liquor comprises from about 2.9 to about 13.4 weight percent sodium sulfide, the anolyte comprises aqueous sulfuric acid containing from about 0.5 to about 10 weight percent sulfuric acid saturated with sulfur dioxide from combustion of hydrogen sulfide from the feed compartment's effluent, the catholyte comprises aqueous caustic containing from about 0.01 to about 5 weight percent sodium hydroxide, and the effluent from the catholyte compartment comprises from about 1 to about 15 weight percent sodium hydroxide.

A chelating agent can be added to the feed solution to prevent the formation of precipitate (fouling) on the membrane surface. Typical chelating agents which can be used include ethylenediaminetetraacetic acid, oxalic acid and ammoniatriacetic acid.

The effectiveness of the subject process of recovering high yields of sulfuric acid, sodium hydroxide and hydrogen can be seen from the following examples. In these examples, a synthetic spent caustic solution containing about 4 (wt)% sodium sulfide and a plant spent caustic solution were used. The three-compartment cell was of the type described in U.S. Pat. No. 3,135,673. Electrodes were platinum, although other electrodes such as platinized carbon electrodes can be used. The cation membrane was Nafion 425, a product of DuPont. Other cation permeation membranes such as CK-1, a product of Asahi Chemical Industry Co., Tokyo Japan, and MC 3470, a product of Ionac Chemical Co., Birmingham N.J., are also suitable.

Embodiments of the process of the present invention may be found in the following examples. These embodiments and examples are presented for purposes of illustration only and are not intended to limit the scope of the invention.

EXAMPLE I

The three-compartment electrolytic cell was used in a batch recirculating mode. Cation permeation membranes used were Nafion 425, a product of DuPont. Platinum electrodes were used as cathode and anode.

To demonstrate the electrolytic step, 0.3 liter of a synthetic spent caustic solution containing about 4 (wt)% $Na_2S$ was used. A small amount 0.5 (wt)%, of $Na_2SO_4$ was also added to this synthetic solution to prevent voltage from rising drastically after $Na_2S$ removal. The anolyte was about 1 liter of a 1 (wt)% $H_2SO_4$ solution saturated with $SO_2$. The catholyte was 0.3 liter of a 2 (wt)% NaOH solution.

Results of this demonstration run at about 108 mA/cm$^2$ and 4–5 volts are summarized in Table I.

TABLE I

| | Anode Compartment | | | |
|---|---|---|---|---|
| Time, hr | Vol., l | $H_2SO_3$, g/l | $H_2SO_4$, g/l | $O_2$, l |
| 0.0 | 1.01 | 36.0 | 10.1 | 0.00 |
| 0.5 | 0.99 | — | — | 0.00 |
| 1.0 | 0.97 | 28.8 | 18.7 | 0.00 |
| 1.5 | 0.96 | — | — | 0.00 |
| 2.0 | 0.95 | 21.4 | 26.2 | 0.00 |
| 2.5 | 0.94 | 17.8 | 31.1 | 0.00 |
| 3.0 | 0.93 | 13.9 | 35.3 | 0.00 |

| Feed Compartment | | Cathode Compartment | | |
|---|---|---|---|---|
| Vol., l | Total Sulfur, g/l | Vol., l | NaOH, g/l | $H_2$, l |
| 0.30 | 16.9 | 0.30 | 19.5 | 0.00 |
| 0.30 | — | 0.31 | 31.0 | 1.10 |
| 0.29 | 16.8 | 0.32 | 41.5 | 2.10 |
| 0.28 | — | 0.34 | 52.0 | 3.10 |
| 0.28 | 11.4 | 0.35 | 61.5 | 4.15 |
| 0.27 | 6.1 | 0.36 | 71.0 | 5.15 |
| 0.26 | 2.6 | 0.37 | 79.0 | 6.15 |

Note:
5 amps (~108 mA/cm$^2$); batch recirculation

Hydrogen sulfide gas from the feed compartment is oxidized externally to sulfur dioxide and returned to the anode compartment.

EXAMPLE II

The procedure of Example I was repeated but with a different feed which contained petroleum hydrocarbons. A plant-spent caustic solution, with its analyses shown in Table II, was used. Results of a batch recirculating run at about 217 mA/cm$^2$ and 6–7 volts are summarized in Table III. A small amount of organics, measured in total organic carbon (TOC), also transported into the cathode compartment. A small increase in TOC in the feed stream was due to the concentration effect by electro-osmotic transport. A white precipitate was found on the surface of the cation permeation membrane facing the cathode, presumably due to corrosion metals in the feed solution.

TABLE II

| Analyses of a Plant Spent Caustic Sample | (wt) |
|---|---|
| Total Sulfur | 1.38% |
| Organic Sulfur | 14 ppm |
| Total Organic Carbon | 965 ppm |
| Alkalinity, mg/l as $CaCO_3$ | |
| Phenolphthalein Alkalinity | 54,000 |
| Methyl Orange Alkalinity | 92,000 |
| Hydroxide Alkalinity | 16,000 |
| Carbonate Alkalinity | 76,000 |

TABLE III

| | Anode Compartment | | | |
|---|---|---|---|---|
| Time, hr | Vol., l | $H_2SO_3$, g/l | $H_2SO_4$, g/l | $O_2$, l |
| 0.0 | 1.46 | 36.2 | 9.7 | 0.00 |
| 0.5 | 1.44 | — | — | 0.00 |
| 1.5 | 1.41 | 19.0 | 30.2 | 0.00 |
| 2.5 | 1.39 | — | — | 0.00 |
| 3.0 | 1.37 | 4.6 | 45.1 | 0.00 |
| 3.5 | 1.35 | 1.9 | 51.7 | 0.00 |

| | Feed Compartment | | |
|---|---|---|---|
| Time, hr | Vol., l | Total Sulfur, g/l | TOC, ppm |
| 0.0 | 0.35 | 13.8 | 965 |
| 0.5 | 0.33 | — | — |
| 1.5 | 0.32 | 14.0 | — |
| 2.5 | 0.29 | — | — |
| 3.0 | 0.28 | 3.4 | — |
| 3.5 | 0.26 | 0.1 | 1020 |

| | Cathode Compartment | | | |
|---|---|---|---|---|
| Time, hr | Vol., l | NaOH, g/l | TOC, ppm | $H_2$, l |
| 0.0 | 0.50 | 40.0 | 0 | 0.0 |
| 0.5 | 0.52 | — | — | 1.8 |
| 1.5 | 0.56 | 73.6 | — | 6.6 |
| 2.5 | 0.59 | — | — | 11.4 |
| 3.0 | 0.62 | 100.0 | — | 13.9 |
| 3.5 | 0.64 | 104.4 | 62 | 16.3 |

Note:
10 amps (~217 mA/cm$^2$); batch recirculation

EXAMPLE III

The procedure of Example II was repeated but 100 ppm of ethylenediaminetetraacetic acid (EDTA) were added to the feed solution to prevent the formation of precipitate (fouling) on the membrane surface. No precipitate was found after a run similar to Example II. Other chelating reagents, e.g., oxalic acid and ammoniatriacetic acid, are also suitable for this application. The results were similar to the results of Example II except that formation of precipitate (fouling) on the membrane surface was prevented.

What is claimed is:

1. A process for regenerating aqueous caustic from aqueous sulfidic waste liquor containing alkali metal sulfides which comprises: (a) feeding said aqueous waste liquor to a feed receiving compartment of a three compartment electrolysis cell comprising an anolyte compartment formed by an anode and a first cation permeable membrane in which said anolyte is an aqueous solution of sulfuric acid and sulfur dioxide, a feed receiving compartment formed by said first cation permeable membrane and a second cation permeable membrane, and a catholyte compartment formed by said second cation permeable membrane and a cathode in which the catholyte is an aqueous solution of sodium hydroxide, (b) subjecting said aqueous sulfidic waste liquor to electrolysis whereby the effluent from said anolyte compartment is aqueous sulfuric acid, the effluent from said feed compartment is hydrogen sulfide and a spent aqueous solution of alkali metal sulfides, and the effluent from said catholyte compartment is hydrogen and regenerated sodium hydroxide in aqueous solution, and (c) oxidizing said hydrogen sulfide in a combustion zone in the presence of oxygen to sulfur dioxide, (d) absorbing said sulfur dioxide in aqueous sulfurous acid and sulfuric acid, and (e) oxidizing said sulfur dioxide and said sulfurous acid to sulfuric acid in said anolyte compartment.

2. The process of claim 1 wherein said feed of aqueous sulfidic waste liquor comprises from about 2.9 to about 13.4 weight percent sodium sulfide, the anolyte comprises aqueous sulfuric acid containing from about 0.5 to about 10 weight percent sulfuric acid saturated with sulfur dioxide and sulfurous acid from oxidation of hydrogen sulfide from the feed compartment's effluent, the catholyte comprises aqueous caustic containing from about 0.01 to about 5 weight percent sodium hydroxide, and the effluent from the catholyte compartment comprises from about 1 to about 15 weight percent sodium hydroxide.

3. The process of claim 1 wherein said feed of aqueous sulfidic waste liquor comprises from about 2.9 to about 13.4 weight percent sodium sulfide, the anolyte comprises aqueous sulfuric acid containing about 1 weight percent sulfuric acid saturated with sulfur dioxide from oxidation of hydrogen sulfide from the feed compartment's effluent, the catholyte comprises aqueous caustic containing about 2 weight percent sodium hydroxide and the effluent from the catholyte compartment comprises from about 3 to about 15 weight percent sodium hydroxide.

4. The process of claim 1 wherein a chelating agent is added to said aqueous sulfidic waste liquor to prevent fouling.

5. The process of claim 4 wherein said chelating agent is selected from the group consisting of ethylenediaminetetraacetic acid, oxalic acid and ammoniatriacetic acid.

* * * * *